US007195040B2

(12) United States Patent
Ward

(10) Patent No.: US 7,195,040 B2
(45) Date of Patent: Mar. 27, 2007

(54) PAPERMAKER'S FORMING FABRIC WITH MACHINE DIRECTION STITCHING YARNS THAT FORM MACHINE SIDE KNUCKLES

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 34 days.

(21) Appl. No.: 11/207,277

(22) Filed: Aug. 19, 2005

(65) Prior Publication Data

US 2006/0185753 A1 Aug. 24, 2006

Related U.S. Application Data

(60) Provisional application No. 60/654,260, filed on Feb. 18, 2005.

(51) Int. Cl.

| | |
|---|---|
| ***D03D 3/04*** | (2006.01) |
| ***D21F 7/08*** | (2006.01) |
| *D03D 11/00* | (2006.01) |
| *D03D 25/00* | (2006.01) |

(52) U.S. Cl. ..... 139/383 A; 139/383 AA; 139/408; 139/411; 139/413

(58) Field of Classification Search ..... 139/383 A, 139/383 AA, 408, 411, 413; 162/358.2, 162/900, 903; 442/203, 205

See application file for complete search history.

(56) References Cited

U.S. PATENT DOCUMENTS

| | | | |
|---|---|---|---|
| 2,172,430 | A | 9/1939 | Barrell |
| 2,554,034 | A | 5/1951 | Koester et al. |
| 3,094,149 | A | 6/1963 | Keily |

(Continued)

FOREIGN PATENT DOCUMENTS

| | | |
|---|---|---|
| DE | 454 092 | 12/1927 |

(Continued)

OTHER PUBLICATIONS

International Search Report for PCT/US2004/008311.

(Continued)

*Primary Examiner*—Robert H Muromoto
(74) *Attorney, Agent, or Firm*—Myers Bigel Sibley & Sajovec

(57) ABSTRACT

A papermaking fabric includes a series of repeat units, each of the repeat units including: a first set of top machine direction (MD) yarns; a second set of top MD yarns; a set of top cross machine direction (CMD) yarns interwoven with the first and second sets of top MD yarns; a set of bottom CMD yarns; and a set of pairs of MD stitching yarns interwoven with the top and bottom CMD yarns, each pair of MD stitching yarns sandwiching an immediately adjacent respective top MD yarn of the second set. The first and second sets of top MD yarns interweave only with the top CMD yarns. The top MD yarns of the first set interweave in a first sequence with the top CMD yarns in which the top MD yarns of the first set form a plurality of top side MD knuckles over the top CMD yarns, and the top MD yarns of the second set interweave with the top CMD yarns in a second sequence that differs from the first sequence that differs from the first sequence in that the top MD yarns of the second set form fewer knuckles than are present in the first sequence. Only stitching yarns interweave with the bottom CMD yarns.

22 Claims, 11 Drawing Sheets

U.S. PATENT DOCUMENTS 3,325,909 A 6/1967 Clark
4,093,512 A 6/1978 Fleischer
4,182,381 A 1/1980 Gisbourne
4,244,543 A 1/1981 Ericson
4,289,173 A 9/1981 Miller
4,290,209 A 9/1981 Buchanan et al.
4,414,263 A 11/1983 Miller et al.
4,438,788 A 3/1984 Harwood
4,452,284 A 6/1984 Eckstein et al.
4,453,573 A 6/1984 Thompson
4,501,303 A 2/1985 Osterberg
4,515,853 A 5/1985 Borel
4,529,013 A 7/1985 Miller
4,564,052 A 1/1986 Borel
4,564,551 A 1/1986 Best
4,592,395 A 6/1986 Borel
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A 4/1988 Borel
4,755,420 A 7/1988 Baker et al.
4,759,975 A 7/1988 Sutherland et al.
4,815,499 A 3/1989 Johnson
4,815,503 A 3/1989 Borel
4,909,284 A 3/1990 Kositzke
RE33,195 E 4/1990 McDonald et al.
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A 1/1991 Wilson
4,989,647 A 2/1991 Marchand
4,989,648 A 2/1991 Tate et al.
4,998,568 A 3/1991 Vohringer
4,998,569 A 3/1991 Tate
5,022,441 A 6/1991 Tate et al.
5,025,839 A 6/1991 Wright
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,152,326 A 10/1992 Vohringer
5,158,118 A 10/1992 Tate et al.
5,219,004 A * 6/1993 Chiu ..... 139/383 A
5,228,482 A 7/1993 Fleischer
5,277,967 A 1/1994 Zehle et al.
5,358,014 A 10/1994 Kovar
5,421,374 A 6/1995 Wright
5,421,375 A 6/1995 Praetzel
5,429,686 A 7/1995 Chiu et al.
5,437,315 A 8/1995 Ward
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,641,001 A 6/1997 Wilson
5,651,394 A 7/1997 Marchand
5,709,250 A * 1/1998 Ward et al. ..... 139/383 A
RE35,777 E 4/1998 Givin
5,746,257 A 5/1998 Fry
5,826,627 A 10/1998 Seabrook et al.
5,857,498 A 1/1999 Barreto et al.
5,881,764 A * 3/1999 Ward ..... 139/383 A
5,894,867 A * 4/1999 Ward et al. ..... 139/383 A
5,899,240 A 5/1999 Wilson
5,937,914 A 8/1999 Wilson
5,967,195 A * 10/1999 Ward ..... 139/383 A
5,983,953 A 11/1999 Wilson
6,073,661 A 6/2000 Wilson
6,112,774 A 9/2000 Wilson
6,123,116 A 9/2000 Ward et al.
6,145,550 A 11/2000 Ward
6,148,869 A 11/2000 Quigley
6,158,478 A 12/2000 Lee et al.
6,179,965 B1 1/2001 Cunnane et al.
6,202,705 B1 * 3/2001 Johnson et al. ..... 139/383 A
6,207,598 B1 3/2001 Lee et al.
6,227,255 B1 5/2001 Osterberg et al.
6,237,644 B1 5/2001 Hay et al.
6,240,973 B1 6/2001 Stone et al.
6,244,306 B1 6/2001 Troughton
6,253,796 B1 * 7/2001 Wilson et al. ..... 139/383 A
6,276,402 B1 8/2001 Herring
6,379,506 B1 * 4/2002 Wilson et al. ..... 162/348
6,581,645 B1 6/2003 Johnson et al.
6,585,006 B1 7/2003 Wilson et al.
6,896,009 B2 * 5/2005 Ward ..... 139/383 A
6,920,902 B2 * 7/2005 Majaury et al. ..... 139/383 A
6,959,737 B2 * 11/2005 Ward ..... 139/383 A
7,059,357 B2 * 6/2006 Ward ..... 139/348
7,059,360 B1 * 6/2006 Majaury et al. ..... 139/383 A
7,059,361 B1 * 6/2006 Hansson ..... 139/383 A
7,124,781 B2 * 10/2006 Fahrer et al. ..... 139/383 A
2003/0010393 A1 1/2003 Kuji
2004/0079434 A1 * 4/2004 Martin et al. ..... 139/383 A
2004/0102118 A1 5/2004 Hay et al.
2004/0118473 A1 * 6/2004 Hay et al. ..... 139/383 R
2004/0182465 A1 9/2004 Ward

FOREIGN PATENT DOCUMENTS

DE 33 29 740 3/1985
EP 0 048 962 9/1981
EP 0 158 710 10/1984
EP 0 185 177 10/1985
EP 0 224 276 12/1986
EP 0 264 881 10/1987
EP 0 269 070 11/1987
EP 0 284 575 2/1988
EP 0 283 181 3/1988
EP 0 350 673 6/1989
EP 0 408 849 A2 5/1990
EP 0 408 849 A3 5/1990
EP 0 672 782 3/1995
EP 0 794 283 A1 9/1997
FR 2 597 123 4/1986
GB 2157328 A 10/1985
GB 2245006 2/1991
JP 8-158285 12/1994
WO WO 86/00099 1/1986
WO WO 89/09848 4/1989
WO WO 3/10304 11/1992
WO WO 99/61698 12/1999
WO WO 02/00996 1/2002

WO WO 03/093573 A1 11/2003

OTHER PUBLICATIONS

European Search Report corresponding to application No. EP 05002306.8, dated Oct. 18, 2005.
International Search Report for PCT Application No. PCT/US97/18629.
Rule 132 Declaration of Robert G. Wilson (Jun. 26, 1997).
Warren, C.A., "The Importance of Yarn Properties in Wet-End Wire Construction," Seminar, The Theory of Water Removal, Dec. 12, 1979.
European Search Report for Application No. 06003182.0 dated Jun. 7, 2006.

* cited by examiner 131 132 133 134 135 136 137 138 139 140 141 142
111
151 152 153 154 155 156

137
121
152
155

112
133
135
139
141

122
152
155

113

123
133
153
156

131
137
114
135
141

124
153
139

115

125
151
154
141
116

131
133
137
139

126
151
135
154

PAPERMAKER'S FORMING FABRIC WITH MACHINE DIRECTION STITCHING YARNS THAT FORM MACHINE SIDE KNUCKLES

RELATED APPLICATION

This application claims priority from U.S. Provisional Patent Application No. 60/654,260, filed Feb. 18, 2005, the disclosure of which is hereby incorporated herein in its entirety.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. No. 5,437,315 to Ward and U.S. Pat. No. 5,967,195 to Ward.

International Appln. No. PCT/US2004/008311, filed Mar. 18, 2004, describes a number of exemplary multi-layer forming fabrics that are "warped-stitched." In some instances such fabrics may be easier to manufacture than weft-stitched forming fabrics and/or may have desirable performance properties. However, there is still a demand for additional types of warp-stitched fabrics to meet the vast array of papermaking needs.

SUMMARY OF THE INVENTION

As a first aspect, embodiments of the present invention are directed to a papermaking fabric, comprising a series of repeat units, each of the repeat units including: a first set of top machine direction (MD) yarns; a second set of top MD yarns; a set of top cross machine direction (CMD) yarns interwoven with the first and second sets of top MD yarns; a set of bottom CMD yarns; and a set of pairs of MD stitching yarns interwoven with the top and bottom CMD yarns, each pair of MD stitching yarns sandwiching a respective immediately adjacent top MD yarn of the second set. The first and second sets of top MD yarns interweave only with the top CMD yarns. The top MD yarns of the first set interweave in a first sequence with the top CMD yarns in which the top MD yarns of the first set form a plurality of top side MD knuckles over the top CMD yarns, and the top MD yarns of the second set interweave with the top CMD yarns in a second sequence that differs from the first sequence in that the top MD yarns of the second set form two fewer knuckles than are present in the first sequence. Each of the stitching yarns forms a knuckle over a top CMD yarn.

As a second aspect, embodiments of the present invention are directed to a papermaking fabric, comprising a series of repeat units, each of the repeat units including: a first set of top machine direction (MD) yarns; a second set of top MD yarns; a set of top cross machine direction (CMD) yarns interwoven with the first and second sets of top MD yarns; a set of bottom CMD yarns; and a set of pairs of MD stitching yarns interwoven with the top and bottom CMD yarns, each pair of MD stitching yarns sandwiching an immediately adjacent respective top MD yarn of the second set. The first and second sets of top MD yarns interweave only with the top CMD yarns. The top MD yarns of the first set interweave in a first sequence with the top CMD yarns in which the top MD yarns of the first set form a plurality of top side MD knuckles over the top CMD yarns, and the top MD yarns of the second set interweave with the top CMD yarns in a second sequence that differs from the first sequence. Each of the stitching yarns forms a knuckle over a top CMD yarn over which the immediately adjacent MD yarn of the second set does not form a knuckle.

As a third aspect, embodiments of the present invention are directed to a papermaking fabric, comprising a series of repeat units, each of the repeat units including: a first set of top machine direction (MD) yarns; a second set of top MD yarns; a set of top cross machine direction (CMD) yarns interwoven with the first and second sets of top MD yarns; a set of bottom CMD yarns; and a set of pairs of MD stitching yarns interwoven with the top and bottom CMD yarns, each pair of MD stitching yarns sandwiching an immediately adjacent respective top MD yarn of the second set. The first and second sets of top MD yarns interweave only with the top CMD yarns. The top MD yarns of the first set interweave in a first sequence with the top CMD yarns in which the top MD yarns of the first set form a plurality of top side MD knuckles over the top CMD yarns, and the top MD yarns of the second set interweave with the top CMD yarns in a second sequence that differs from the first sequence that differs from the first sequence in that the top MD yarns of the second set form fewer knuckles than are present in the first sequence. Only stitching yarns interweave with the bottom CMD yarns.

DETAILED DESCRIPTION OF EMBODIMENTS OF THE INVENTION

Figure 1:
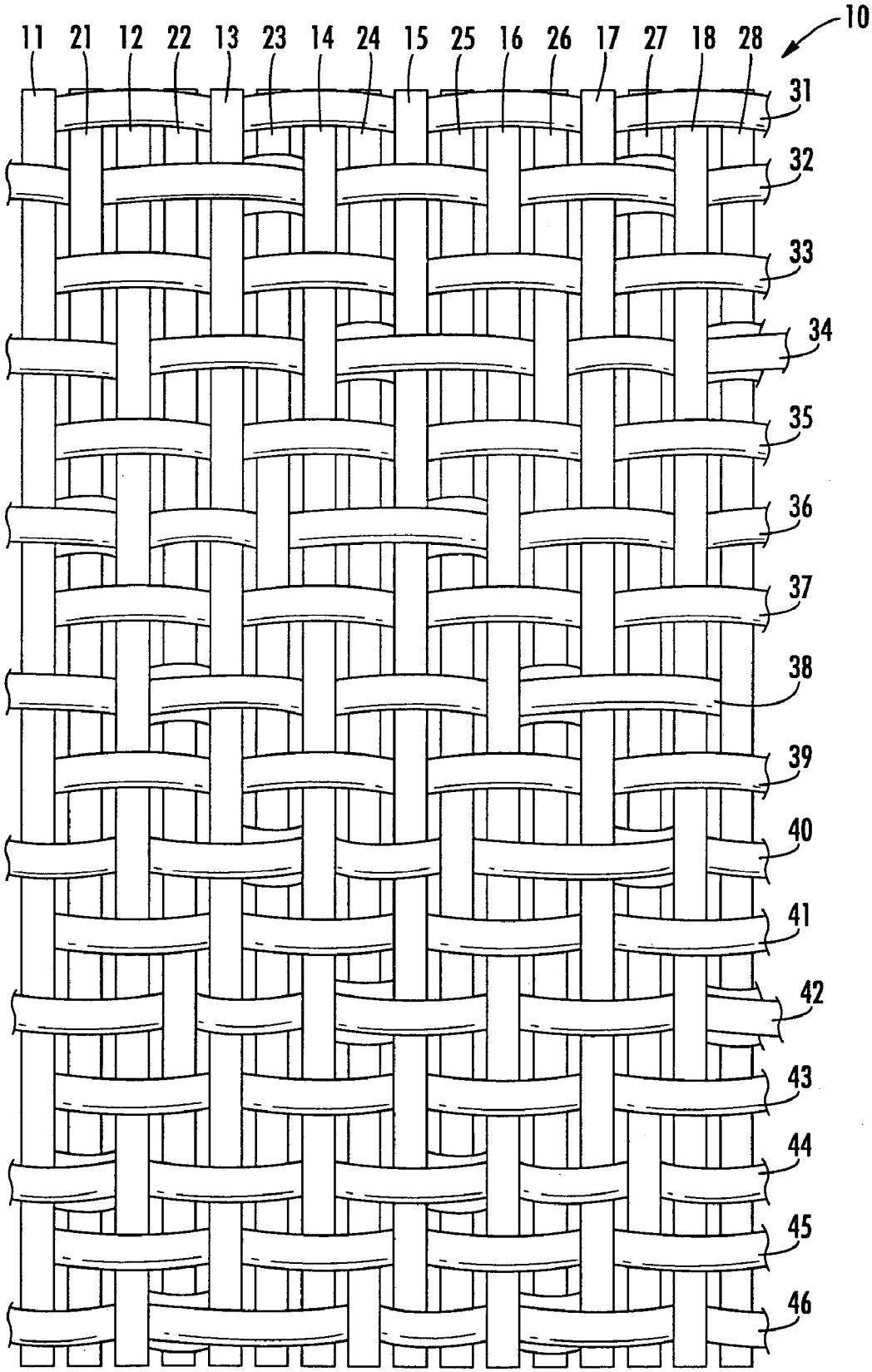
FIG. 1 is a top view of a repeat unit of a forming fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Turning now to FIGS. 1–3L, a repeat unit of a forming fabric according to embodiments of the present invention, designated broadly at 10, is illustrated therein. The repeat unit 10 includes eight top MD yarns 11–18, eight stitching MD yarns 21–28, 16 top CMD yarns 31–46, and eight bottom CMD yarns 51–58. The interweaving of these yarns is described below.

As can be seen in FIGS. 1, 3A, 3E, 31 and 3M, each of the odd numbered top MD yarns 11, 13, 15, 17 interweaves with the top CMD yarns 31–46 in an "over 1/under 1" sequence, in which the top MD yarns 11, 13, 15, 17 pass over the odd-numbered top CMD yarns 31, 33, 35, 37, 39, 41, 43, 45 and under the even-numbered top CMD yarns 32, 34, 36, 38, 40, 42, 44, 46. As can be seen in FIGS. 1, 3C, 3G, 3K and 30, each of the even-numbered top MD yarns 12, 14, 16, 18 follows an "over 1/under 1" pattern relative to the top CMD yarns to form four consecutive MD knuckles (passing over even-numbered top CMD yarns), passes below three consecutive top CMD yarns, forms two more consecutive MD knuckles by passing over even-numbered top CMD yarns, and passes below three more consecutive top CMD yarns. For example, top MD yarn 12 passes over top CMD yarns 34, 36, 38 and 40 while passing below top CMD yarns 35, 37 and 39, then passes below top CMD yarns 41–43, passes above top CMD yarns 44 and 46 while passing below top CMD yarn 45, then passes below top CMD yarns 31–33.

It will be noted that each of the even-numbered top MD yarns 12, 14, 16,18 forms all but two top MD knuckles of a complete "over 1/under 1" top MD yarn. More specifically, in the segments of each top MD yarn 12, 14, 16, 18 that pass below three consecutive top CMD yarns, the second of those three top CMD yarns would ordinarily have a top MD yarn form an MD knuckle over it in order for a complete "over 1/under 1" sequence to be present. These knuckles are provided instead by pairs of stitching MD yarns 21–28, as each of the stitching yarns 21–28 passes over one even-numbered top CMD yarn adjacent the segment of an even-numbered top MD yarn that passes below three consecutive top CMD yarns (see FIGS. 1 and 3B–3P). Using the example of top MD yarn 12 discussed above, top MD yarn 12 passes below even-numbered top CMD yarns 42 and 32 (see FIG. 3C). Stitching yarn 21, which is immediately adjacent top MD yarn 12 (on its left side from the vantage point of FIG. 1), passes over top CMD yarn 32 (see FIG. 3B). In addition, paired stitching yarn 22, which is also immediately adjacent top MD yarn 12 (on its right side from the vantage point of FIG. 1), passes over top CMD yarn 42 (see FIG. 3D). Thus, the combination of top MD yarn 12 and the pair of stitching yarns 21, 22 forms a "composite" top MD yarn that follows an "over 1/under 1" sequence throughout the repeat unit 10. The resulting pattern of knuckles of the actual "over 1/under 1" sequence of the odd-numbered top MD yarns 11, 13, 15, 17 and the composite "over 1/under 1" sequence of the even-numbered top MD yarns 12, 14, 16, 18 and the stitching yarns 21–28 forms a plain weave papermaking surface for the fabric.

Figure 2:
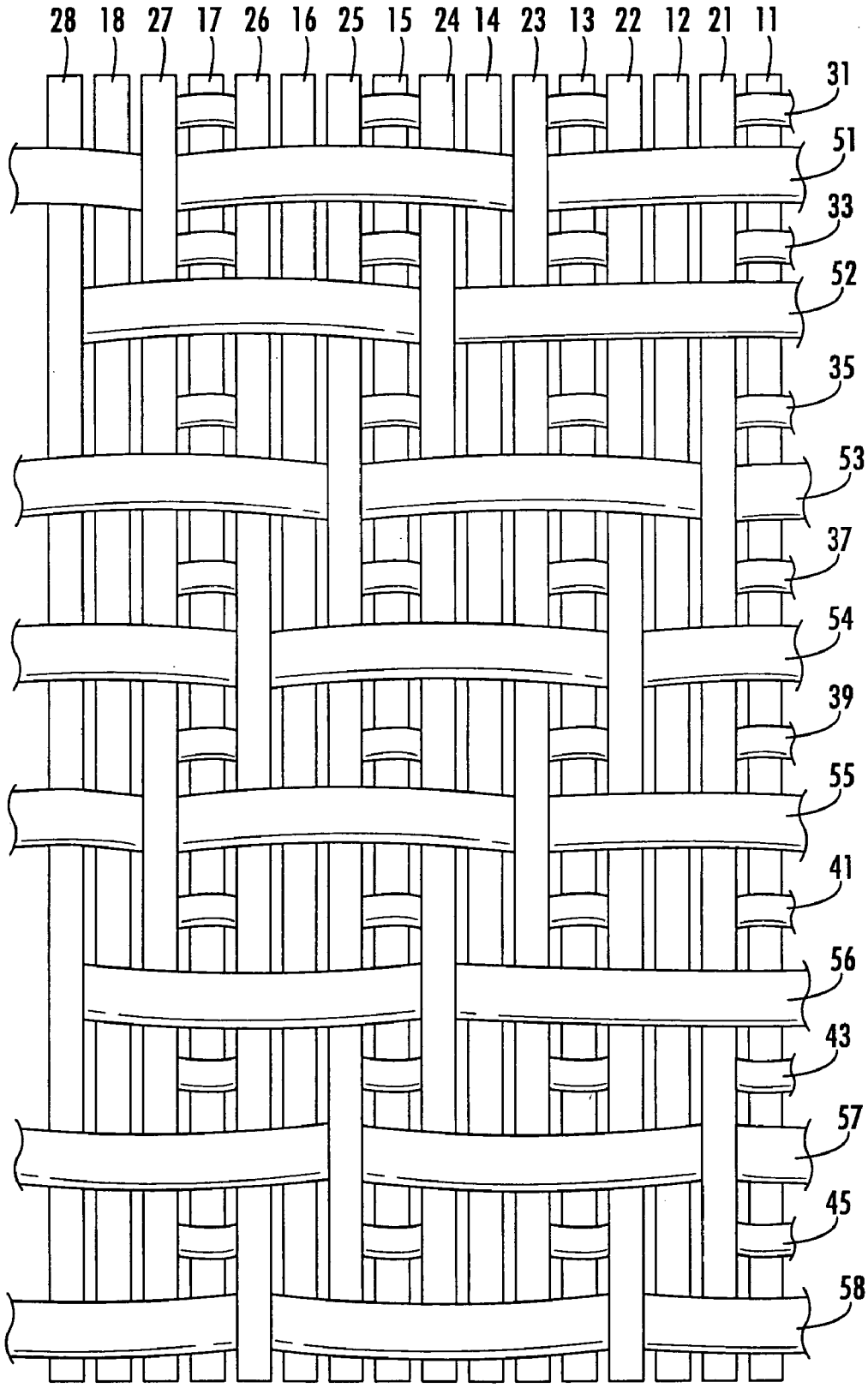
FIG. 2 is a bottom view of the repeat unit of the fabric of FIG. 1.
Figure 3A:
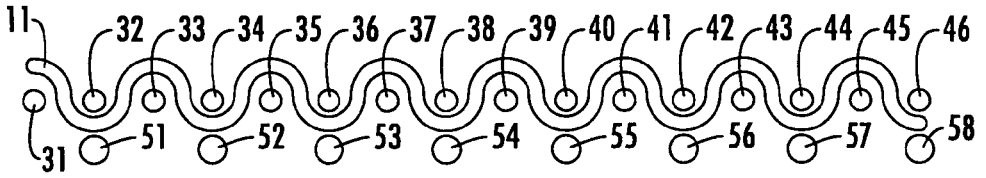
FIGS. 3A–3P are section views taken of machine direction yarns of the fabric of FIG. 1.
Figure 3B:
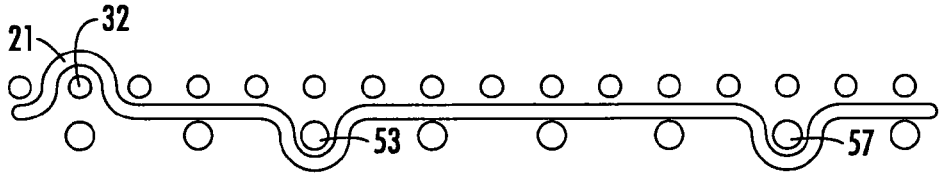
Figure 3C:
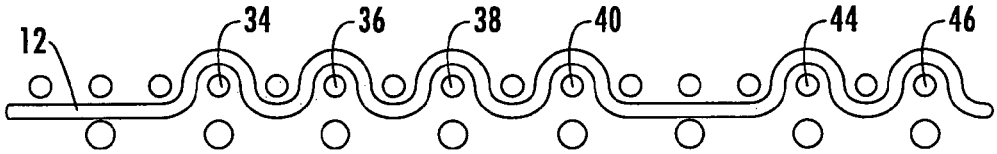
Figure 3D:
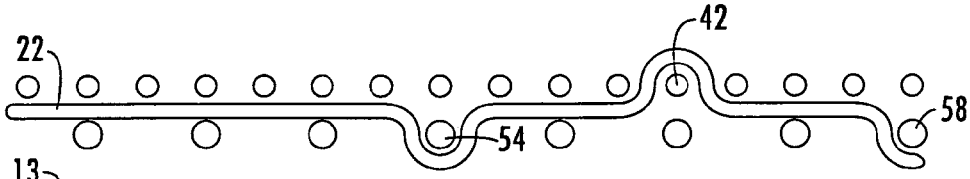
Figure 3E:
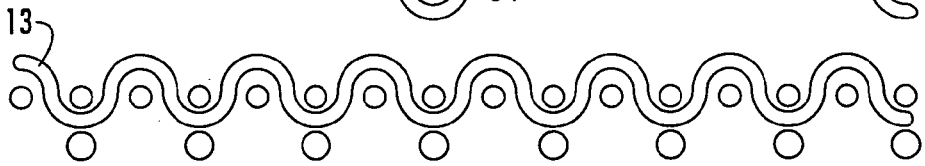
Figure 3F:
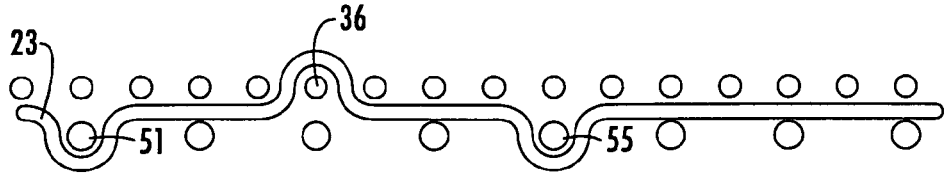
Figure 3G:
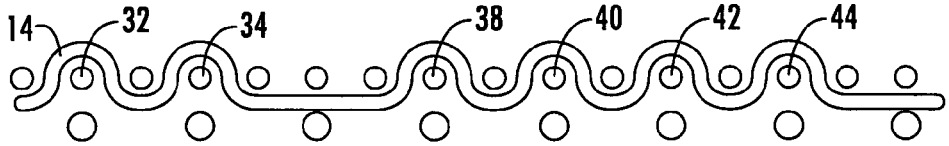
Figure 3H:
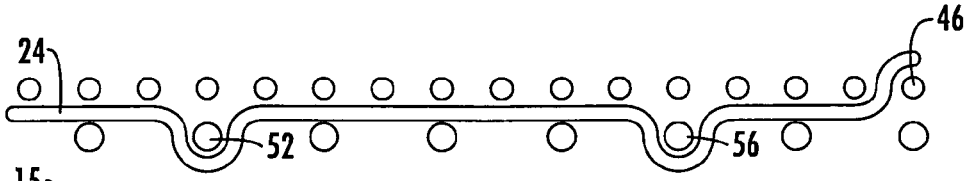
Figure 3I:
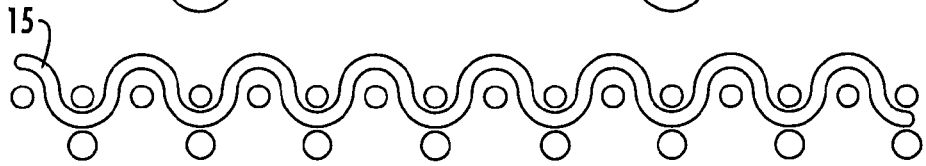
Figure 3J:
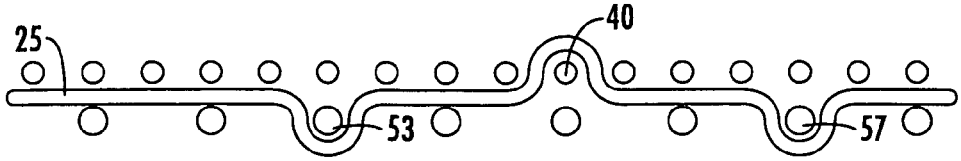
Figure 3K:
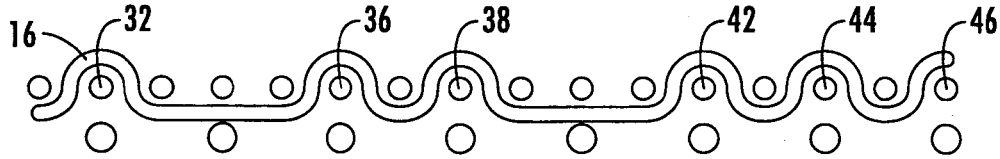
Figure 3L:
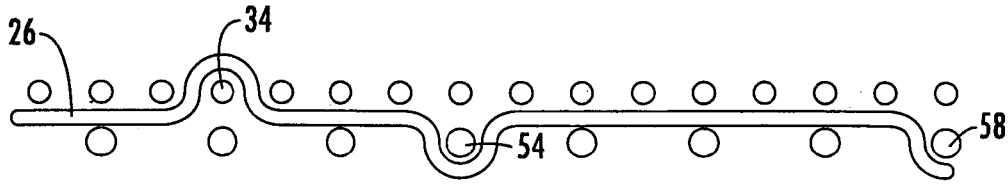
Figure 3M:
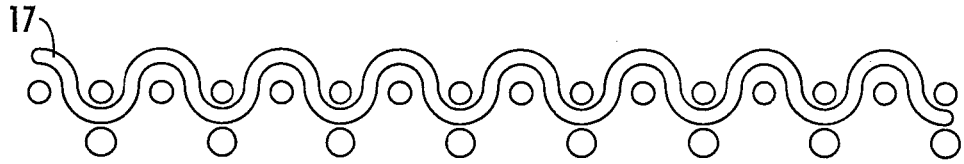
Figure 3N:
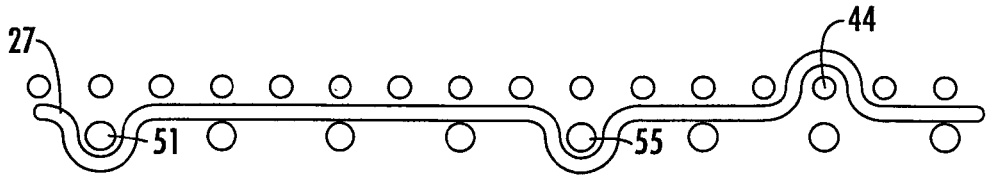
Figure 3O:
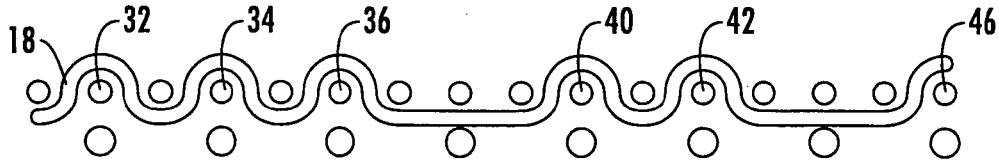
Figure 3P:
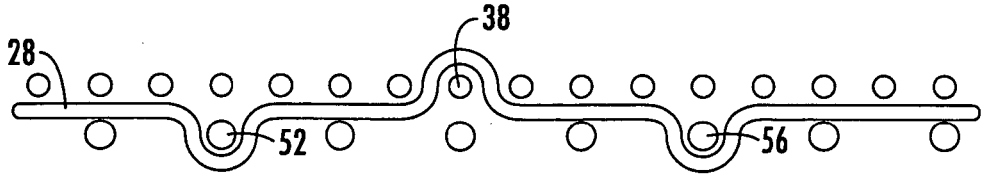
Figure 4:
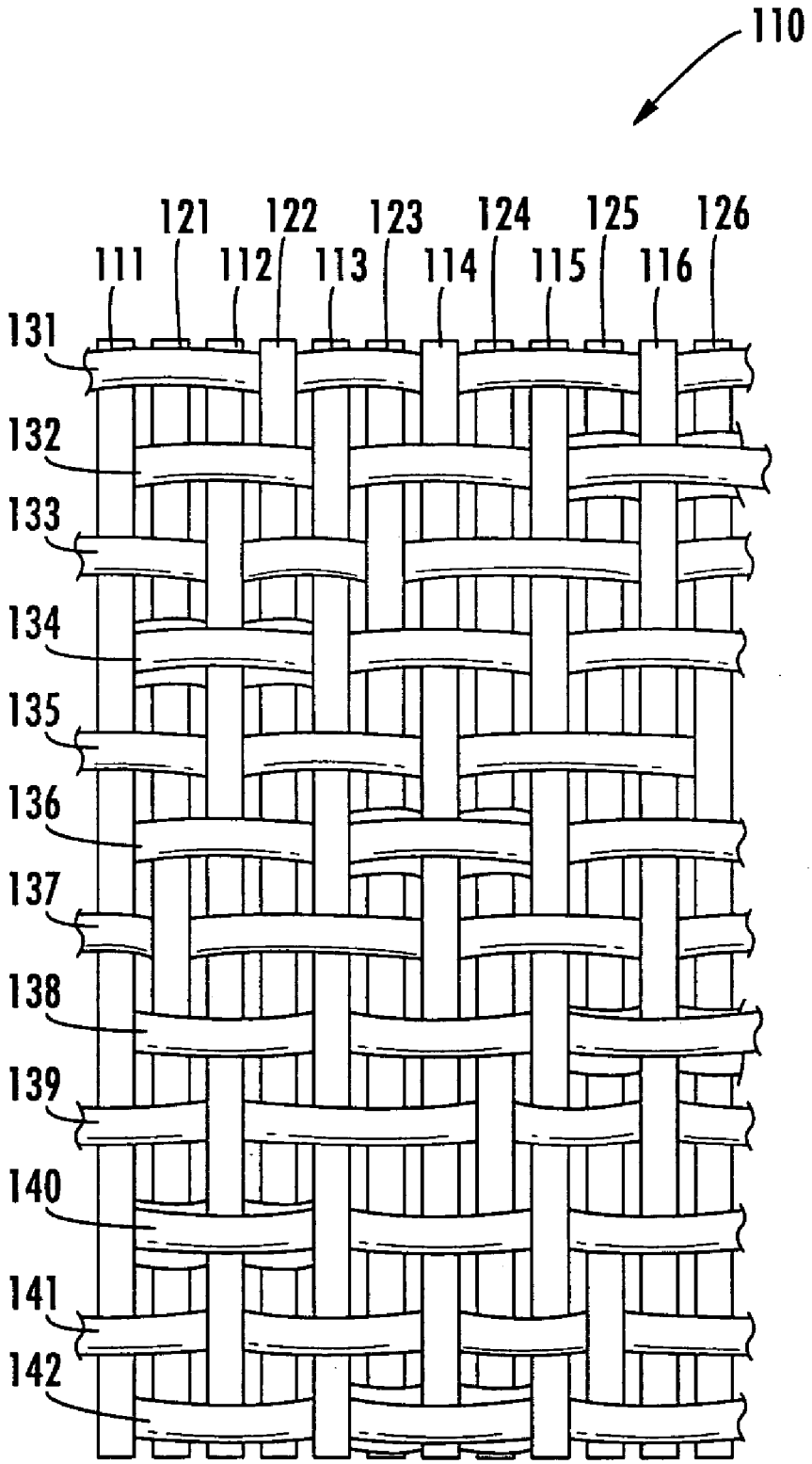
FIG. 4 is a top view of a repeat unit of a forming fabric according to other embodiments of the present invention.
Figure 5:
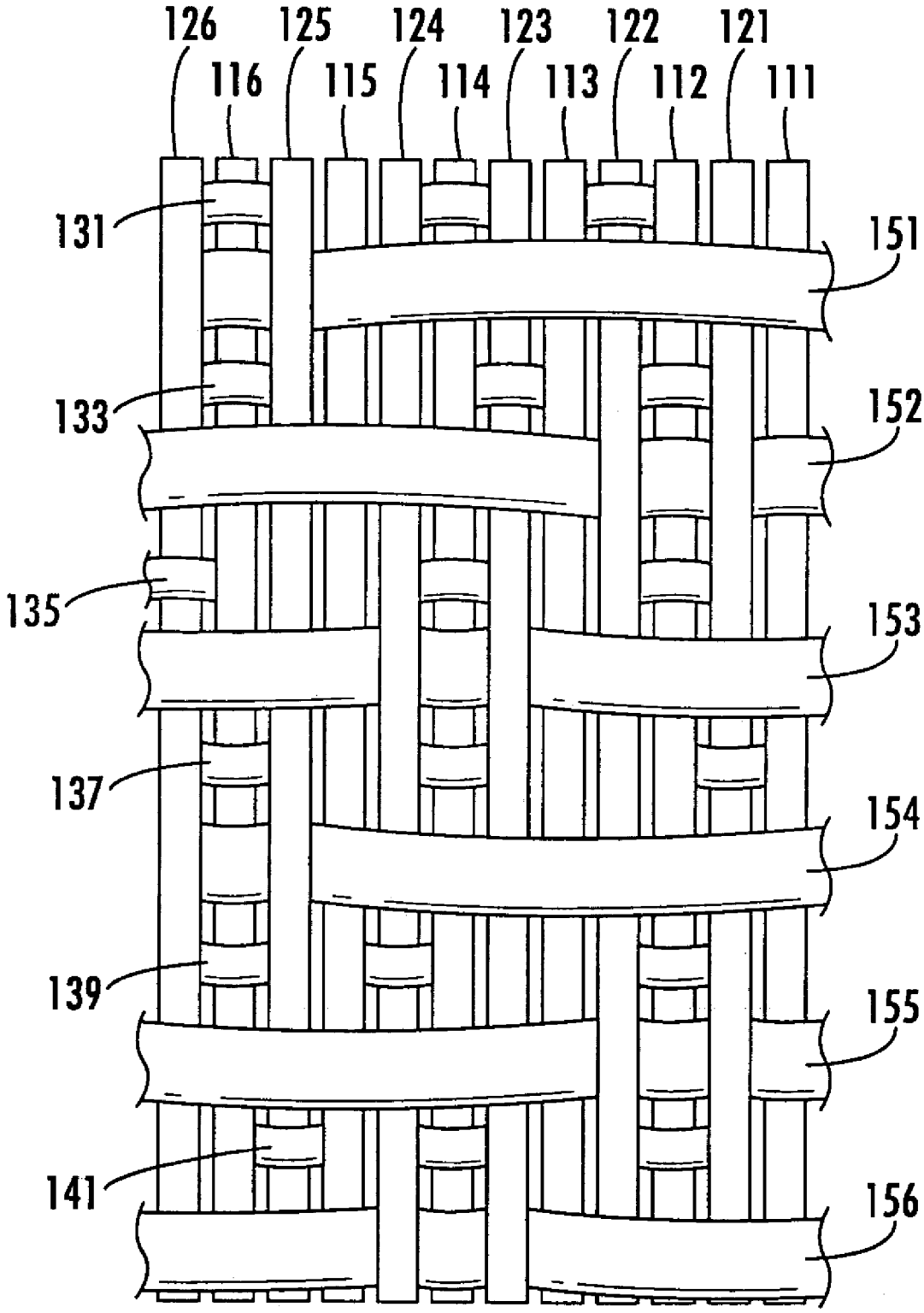
FIG. 5 is a bottom view of the repeat unit of the fabric of FIG. 4.
Figures 6A, 6B, 6C, 6D, 6E, 6F, 6G, 6H, 6I, 6J, 6K, 6L:
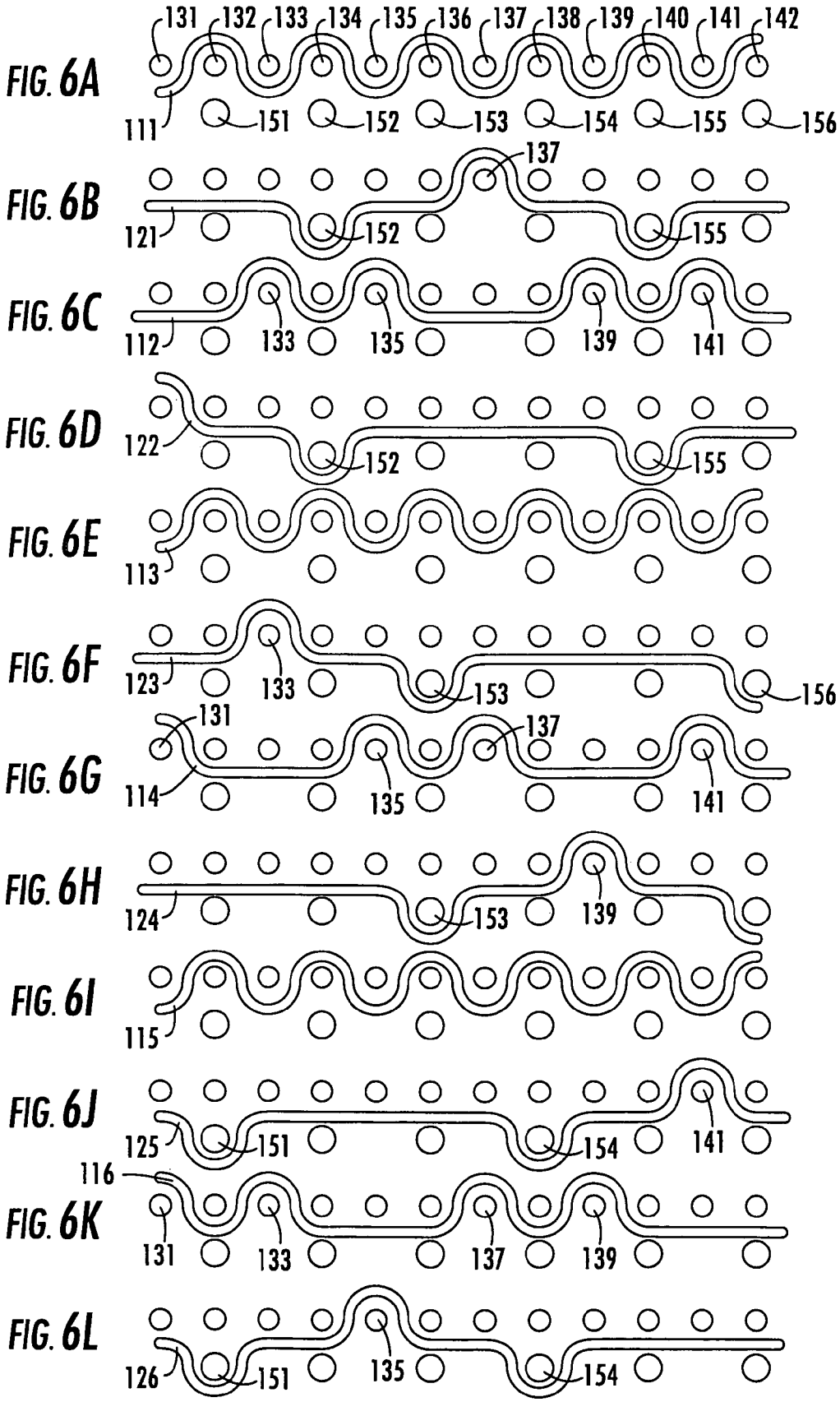
FIGS. 6A–6L are section views taken of machine direction yarns of the fabric of FIG. 4.
Figure 7:
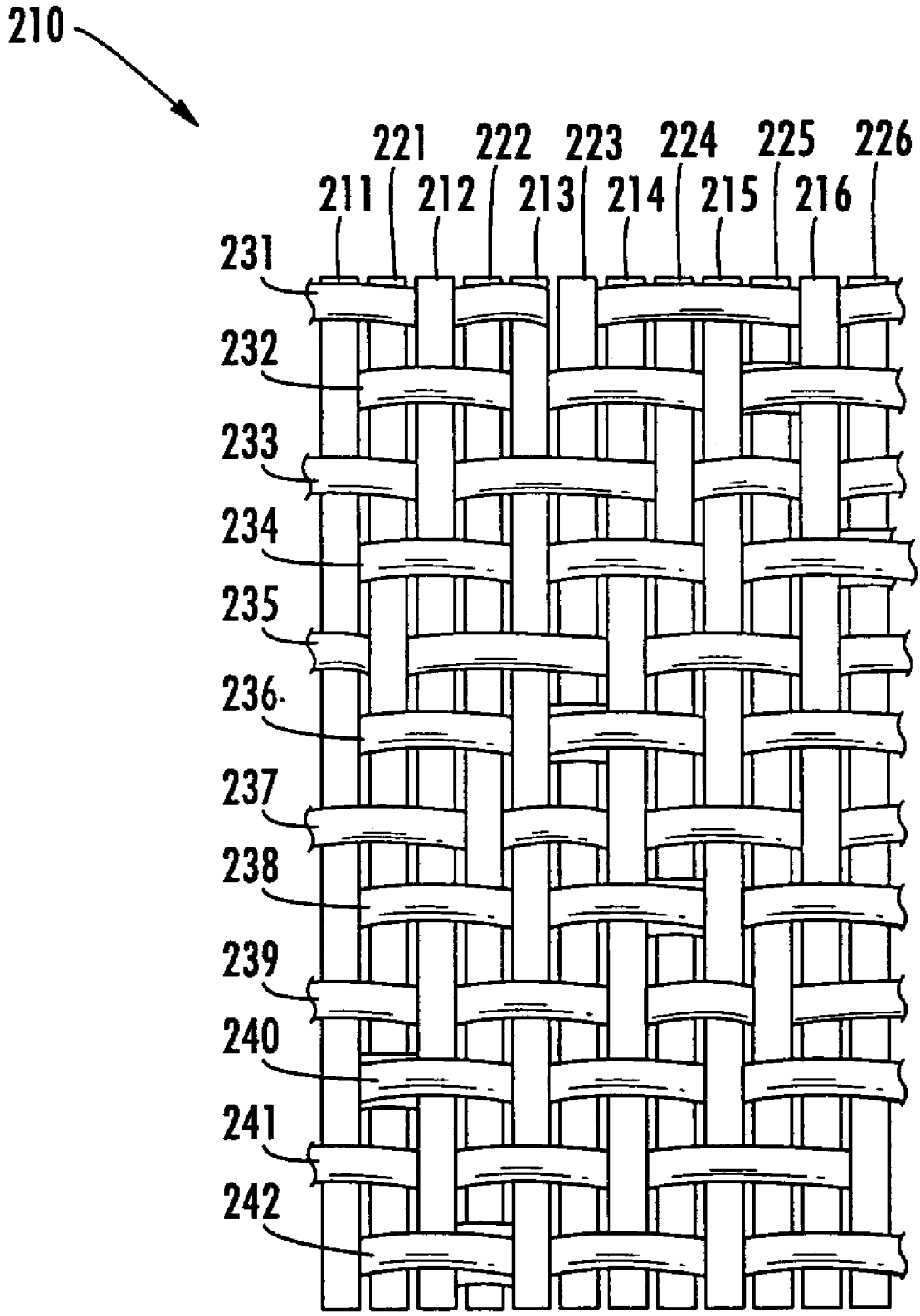
FIG. 7 is a top view of a repeat unit of a forming fabric according to additional embodiments of the present invention.
Figure 8:
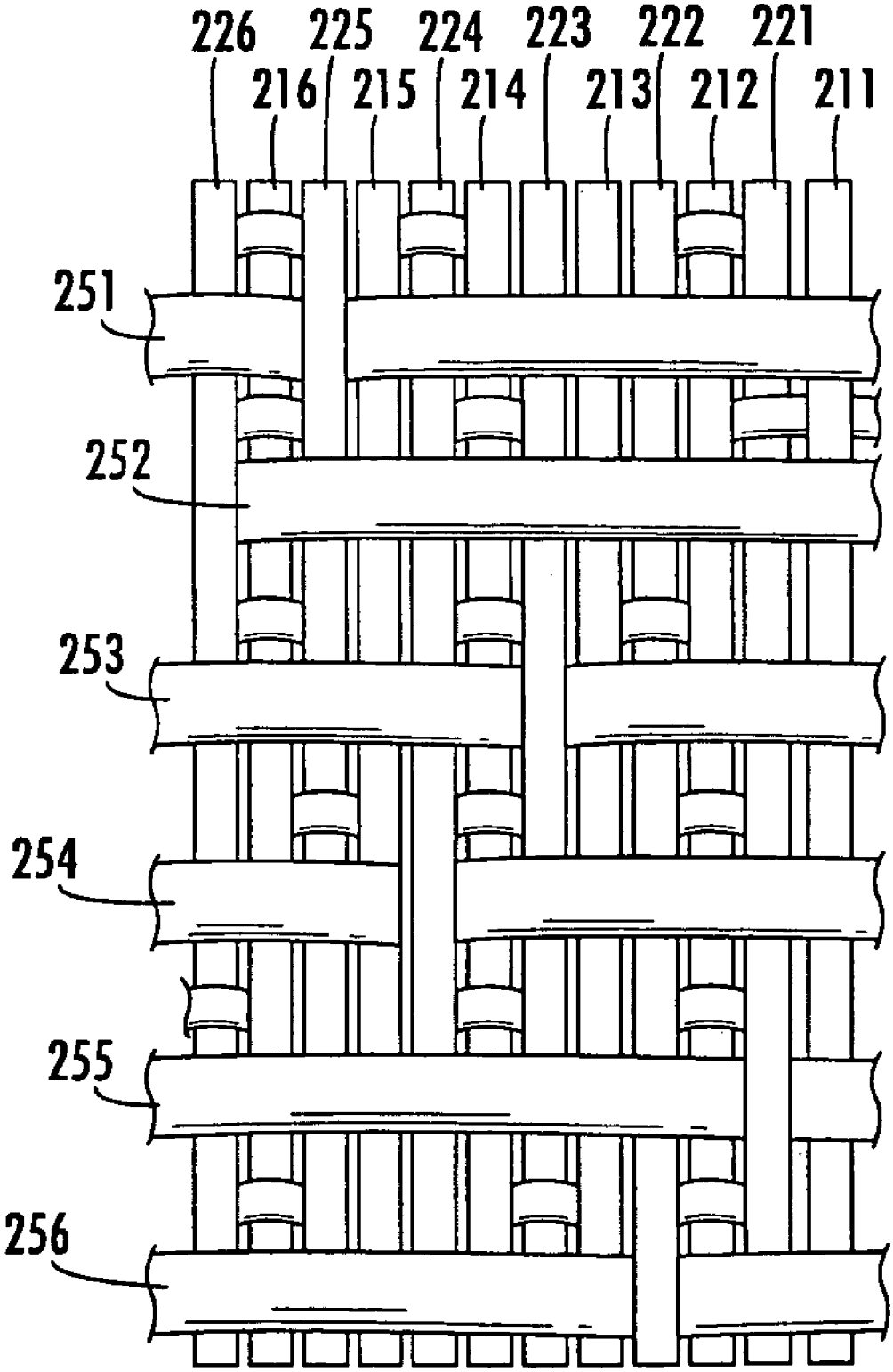
FIG. 8 is a bottom view of the repeat unit of the fabric of FIG. 7.
Figure 9A:
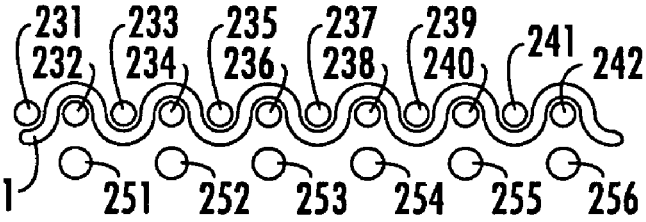
FIGS. 9A–9L are section views taken of machine direction yarns of the fabric of FIG. 7.
Figure 9B:
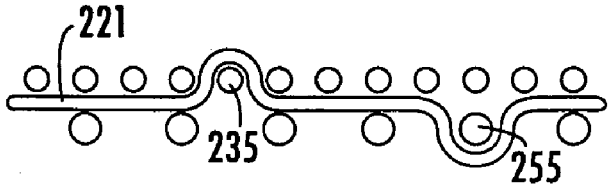
Figure 9C:
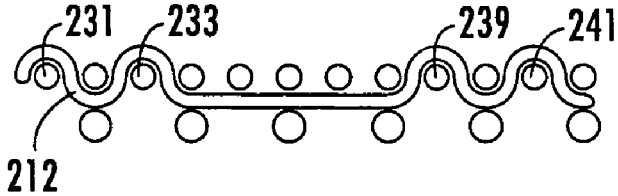
Figure 9D:
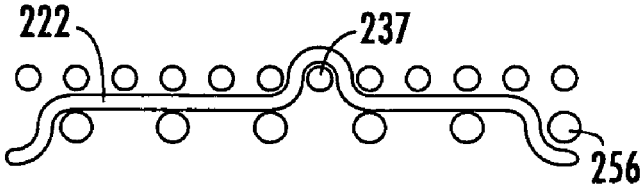
Figure 9E:
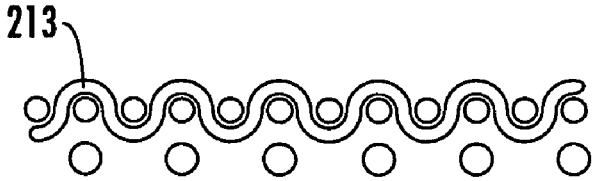
Figure 9F:
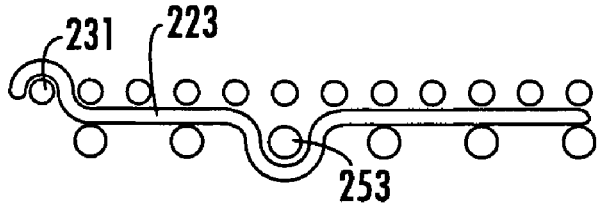
Figure 9G:
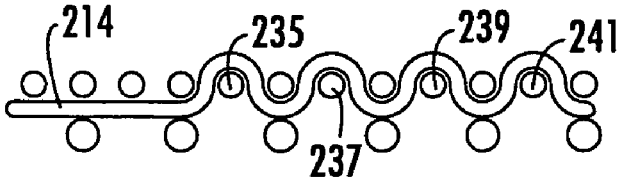
Figure 9H:
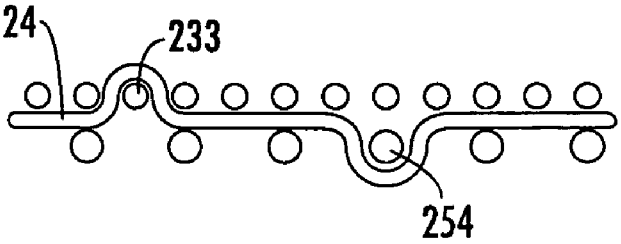
Figure 9I:
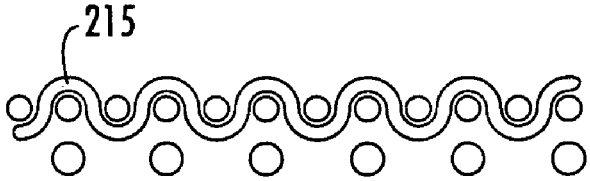
Figure 9J:
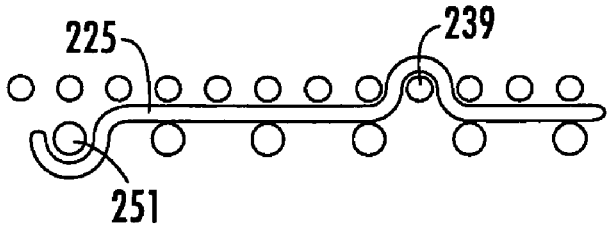
Figure 9K:
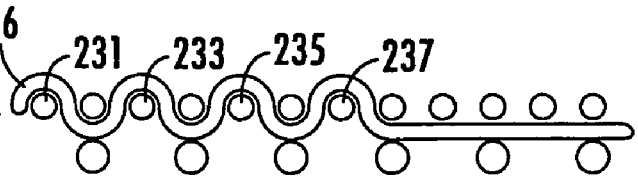
Figure 9L:
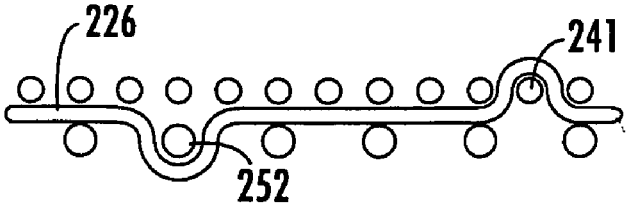

Turning now to FIG. 2 and also to FIGS. 3B–3P, the stitching yarns 21–28 also interweave with the bottom CMD yarns 51–58. Each of the stitching yarns 21–28 passes below two bottom CMD yarns in following an "over 3/under 1" pattern. For example, and referring to FIG. 3B, stitching yarn 21 passes over bottom CMD yarns 58, 51 and 52, passes under bottom CMD yarn 53, passes over bottom CMD yarns 54–56, and passes under bottom CMD yarn 57. Each stitching yarn passes below bottom CMD yarns that are offset from the top CMD yarn the stitching yarn passes over by four top CMD yarns. Referring again to FIG. 3B, stitching yarn 21 passes above top CMD yarn 32 and below bottom CMD yarns 57 and 53, each of which is offset from top CMD yarn 32 by four top CMD yarns.

Adjacent stitching yarns are offset from each other by six top CMD yarns (or three bottom CMD yarns). For example, stitching yarn 22 forms a top MD knuckle by passing over top CMD yarn 42. Adjacent stitching yarn 23 forms a top MD knuckle by passing over top CMD yarn 36 (an offset of six top MD yarns). This offset is repeated throughout the repeat unit. This offset forms a diagonal pattern of machine side knuckles on the machine surface of the fabric (see FIG. 2).

It should be noted that the paths of the stitching yarns 21–28 are quite similar, with each forming one paper side knuckle and two machine side knuckles. As such, each of these stitching yarns, whether they be even- or odd-numbered, can be woven off of the same weaving warp beam, as they would typically be woven with very similar tension therein to provide the desired degree of crimp. The top MD yarns can then be woven off of a second warp beam. The ability to weave this fabric from two warp beams can simplify the weaving process and can help to control crimp. Also, fabrics of the present invention can have very good paper side topography.

Referring now to FIGS. 4–6L, another embodiment of a repeat unit of a fabric of the present invention, designated broadly at 110, is illustrated therein. The repeat unit 110 of the fabric includes six top MD yarns 111–116, six MD stitching yarns 121–126, twelve top CMD yarns 131–142, and six bottom CMD yarns 151–156. These yarns are interwoven as described below.

Referring first to FIGS. 4, 6A, 6E and 61, the three odd-numbered top MD yarns 111, 113, 115 interweave with the top CMD yarns 131–142 in an "over 1/under 1" sequence, with each of the odd-numbered CMD yarns 111, 113, 115 passing over the even-numbered top CMD yarns 132, 134,136, 138, 140, 142 and under the odd-numbered top CMD yarns 131, 133, 135, 137, 139, 141. Referring to FIGS. 4, 6C, 6G, and 6K, the three even-numbered top MD yarns 112, 114, 116 interweave with the top CMD yarns in much the same manner as the even-numbered top MD yarns in the fabric 10 above: namely, they follow an "over 1/under 1" pattern with the top CMD yarns with the exception of two segments in which they pass under three consecutive top CMD yarns (see FIGS. 4, 6C, 6G and 6K). For example, top MD yarn 112 (a) passes below consecutive top CMD yarns 142, 131, 132, (b) passes over top CMD yarn 133, under top CMD yarn 134, and overtop CMD yarn 135, (c) passes below consecutive top CMD yarns 136, 137, 138, and (d) passes over top CMD yarn 139, under top CMD yarn 140, and over top CMD yarn 141.

Stitching yarns 121–126 are interwoven with the top CMD yarns 131–142 in an "over 1/under 11" pattern, and with the bottom CMD yarns in an "over 2/under 1/over 2/under 1" pattern. Notably, each of the stitching yarns 121–126 passes over a top CMD yarn that is the second of three consecutive top CMD yarns that an adjacent even-numbered top MD yarn passes below, with the result that the stitching yarn forms a top MD knuckle that "replaces" the "missing" top knuckle that is not formed by the adjacent even-numbered top MD yarn. For example, referring to FIGS. 4, 6B and 6D, stitching yarn 121 passes over top CMD yarn 137, which is the second of the three consecutive top CMD yarns 136, 137, 138 that top MD yarn 112 passes below. Similarly, stitching yarn 122 passes over top CMD yarn 131, which is the second of the three consecutive top CMD yarns 142, 131, 132 that top MD yarn 112 passes over. As such, the top MD yarn 112 and the knuckles of the stitching yarns 121, 122 form a "composite" top MD yarn that has an overall "over 1/under 1" sequence. Consequently, the odd-numbered top MD yarns 111, 113, 115 and the "composite" top MD yarns formed by the even-numbered top MD yarns 112, 114, 116 and the stitching yarns 121–126 form a plain weave papermaking surface.

Referring now to FIGS. 5 and 6B–6L, it can be seen that the pair of stitching yarns that sandwiches an even-numbered top MD yarn forms machine side MD knuckles below a common bottom MD yarn. For example, stitching yarns 121, 122 each form bottom side MD knuckles below bottom CMD yarns 152, 155 (see FIGS. 5, 6B and 6D). Stitching yarns within a pair that sandwich the same even-numbered top MD yarn are offset from each other by six top CMD yarns (hence the separation of top side MD knuckles formed by such stitching yarns of six top CMD yarns). In contrast, adjacent stitching yarns that sandwich an odd-numbered top MD yarn (ie., stitching yarns from adjacent pairs) are offset from each other by two top CMD yarns (i.e., one bottom CMD yarn). The result on the machine side of the fabric is a diagonal pattern defined by pairs of bottom side MD knuckles formed by the stitching yarns 121–126 (see FIG. 5).

In addition to the performance advantages associated with the fabric 10 described above, the fabric 110 may also have improved air permeability and wear volume due to the presence of long CMD floats on the machine side of the fabric, as well as good edge curl resistance.

Another fabric embodiment of the present invention, represented by a repeat unit 210, is illustrated in FIGS. 7–9L. The repeat unit 210 includes six top MD yarns 211–216, six stitching yarns 221–226, twelve top CMD yarns 231–242 and six bottom CMD yarns 251–256. The interweaving of these yarns is described below.

Referring first to FIGS. 7, 9A, 9E and 91, the three odd-numbered top MD yarns 211, 213, 215 interweave with the top CMD yarns 231–242 in an "over 1/under 1" sequence, with each of the odd-numbered MD yarns 211, 213,215 passing over the even-numbered top CMD yarns 232, 234, 236,238, 240,242 and under the odd-numbered top CMD yarns 231, 233, 235, 237, 239, 241. The three even-numbered top MD yarns 212, 214, 216 interweave with the top CMD yarns in much the same manner as the even-numbered top MD yarns in the fabrics 10, 110 above: namely, they follow an "over 1/under 1" pattern with the top CMD yarns 231–242, passing over odd-numbered top CMD yarn, with the exception of one segment in which they pass under five consecutive top CMD yarns (see FIGS. 7, 9C, 9G and 9K). For example, top MD yarn 212 (a) passes over top CMD yarn 239, under top CMD yarn 240, over top CMD yarn 241, under top CMD yarn 242, over top CMD yarn 231, under top CMD yarn 232, and over top CMD yarn 233, then (b) passes below consecutive top CMD yarns 234–238.

As in the fabrics 10, 110 above, in the fabric 210 the stitching yarns 221–226 each pass over one top CMD yarn to form a top side MD knuckle in a location in which its immediately adjacent even-numbered top MD yarn does not form a knuckle. For example, referring to FIGS. 9B and 9D, stitching yarns 221, 222 form top side MD knuckles over, respectively, odd-numbered top CMD yarns 235, 237, where adjacent even-numbered top MD yarn 212 does not form knuckles. In forming these knuckles, the stitching yarns 221,222 complete a "composite" top MD yarn with top MD yarn 212. As such, the top MD yarns 211–216 and the top side MD knuckles formed by the stitching yarns 221–226 form a plain weave pattern for the papermaking surface of the fabric 210.

In addition, each of the stitching yarns 221–226 forms a machine side MD knuckle by passing below a bottom MD yarn. Again using the stitching yarns 221, 222 as an example, and referring to FIGS. 8, 9B and 9D, stitching yarn 221 forms a bottom side knuckle as it passes below bottom CMD yarn 255, and stitching yarn 222 forms a bottom side knuckle as it passes below bottom CMD yarn 256. Adjacent pairs of stitching yarns (again, a pair being two stitching yarns that sandwich an even-numbered top MD yarn) are offset from each other by two top CMD yarns (or one bottom CMD yarn). Adjacent stitching yarns that sandwich an odd-numbered top MD yarn are offset from each other by six top CMD yarns.

In addition to the performance advantages associated with the fabric 10 described above, the fabric 210 may also have improved air permeability and wear volume due to the presence of long MD floats on the machine side of the fabric.

The form of the yarns utilized in fabrics of the present invention can vary, depending upon the desired properties of the final papermaker's fabric. For example, the yarns may be monofilament yarns, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide are preferred.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A papermaking fabric, comprising a series of repeat units, each of the repeat units including:

a first set of top machine direction (MD) yarns;

a second set of top MD yarns;

a set of top cross machine direction (CMD) yarns interwoven with the first and second sets of top MD yarns;

a set of bottom CMD yarns; and a set of pairs of MD stitching yarns interwoven with the top and bottom CMD yarns, each pair of MD stitching yarns sandwiching a respective immediately adjacent top MD yarn of the second set;

wherein the first and second sets of top MD yarns interweave only with the top CMD yarns; and wherein the top MD yarns of the first set interweave in a first sequence with the top CMD yarns in which the top MD yarns of the first set form a plurality of top side MD knuckles over the top CMD yarns, and wherein the top MD yarns of the second set interweave with the top CMD yarns in a second sequence that differs from the first sequence in that the top MD yarns of the second set form two fewer knuckles than are present in the first sequence; and wherein each of the stitching yarns forms a knuckle over a top CMD yarn.

2. The papermaking fabric defined in claim 1, wherein the knuckles formed by the stitching yarns over the top CMD yarns are formed over top CMD yarns over which immediately adjacent top MD yarns of the second set do not form knuckles.

3. The papermaking fabric defined in claim 1, wherein only stitching yarns interweave with the bottom CMD yarns.

4. The papermaking fabric defined in claim 1, wherein each stitching yarn forms two bottom side MD knuckles below a bottom CMD yarn.

5. The papermaking fabric defined in claim 4, wherein the bottom side MD knuckles formed by stitching yarns of the same pair are formed under the same bottom CMD yarn.

6. The papermaking fabric defined in claim 4, wherein each of the stitching yarns forms one bottom side MD knuckle below a bottom CMD yarn.

7. The papermaking fabric defined in claim 6, wherein the bottom side MD knuckles formed of stitching yarns of the same pair are formed on adjacent bottom CMD yarns.

8. The papermaking fabrics defined in claim 1, wherein the top MD yarns of the first and second sets, the top CMD yarns, and the knuckles of the stitching yarns combine to form a plain weave papermaking surface on the fabric.

9. A papermaking fabric, comprising a series of repeat units, each of the repeat units including:

a first set of top machine direction (MD) yarns;

a second set of top MD yarns;

a set of top cross machine direction (CMD) yarns interwoven with the first and second sets of top MD yarns;

a set of bottom CMD yarns; and a set of pairs of MD stitching yarns interwoven with the top and bottom CMD yarns, each pair of MD stitching yarns sandwiching an immediately adjacent respective top MD yarn of the second set;

wherein the first and second sets of top MD yarns interweave only with the top CMD yarns; and wherein the top MD yarns of the first set interweave in a first sequence with the top CMD yarns in which the top MD yarns of the first set form a plurality of top side MD knuckles over the top CMD yarns, and wherein the top MD yarns of the second set interweave with the top CMD yarns in a second sequence that differs from the first sequence; and wherein each of the stitching yarns forms a knuckle over a top CMD yarn over which the immediately adjacent MD yarn of the second set does not form a knuckle.

10. The papermaking fabric defined in claim 9, wherein only stitching yarns interweave with the bottom CMD yarns.

11. The papermaking fabric defined in claim 9, wherein each stitching yarn forms two bottom side MD knuckles below a bottom CMD yarn.

12. The papermaking fabric defined in claim 11, wherein the bottom side MD knuckles formed by stitching yarns of the same pair are formed under the same bottom CMD yarn.

13. The papermaking fabric defined in claim 11, wherein each of the stitching yarns forms one bottom side MD knuckle below a bottom CMD yarn.

14. The papermaking fabric defined in claim 13, wherein the bottom side MD knuckles formed of stitching yarns of the same pair are formed on adjacent bottom CMD yarns.

15. The papermaking fabrics defined in claim 9, wherein the top MD yarns of the first and second sets, the top CMD yarns, and the knuckles of the stitching yarns combine to form a plain weave papermaking surface on the fabric.

16. A papermaking fabric, comprising a series of repeat units, each of the repeat units including:

a first set of top machine direction (MD) yarns;

a second set of top MD yarns;

a set of top cross machine direction (CMD) yarns interwoven with the first and second sets of top MD yarns;

a set of bottom CMD yarns; and a set of pairs of MD stitching yarns interwoven with the top and bottom CMD yarns, each pair of MD stitching yarns sandwiching an immediately adjacent respective top MD yarn of the second set;

wherein the first and second sets of top MD yarns interweave only with the top CMD yarns; and wherein the top MD yarns of the first set interweave in a first sequence with the top CMD yarns in which the top MD yarns of the first set form a plurality of top side MD knuckles over the top CMD yarns, and wherein the top MD yarns of the second set interweave with the top CMD yarns in a second sequence that differs from the first sequence that differs from the first sequence in that the top MD yarns of the second set form fewer knuckles than are present in the first sequence; and wherein only stitching yarns interweave with the bottom CMD yarns.

17. The papermaking fabric defined in claim 16, wherein each stitching yarn forms two bottom side MD knuckles below a bottom CMD yarn.

18. The papermaking fabric defined in claim 17, wherein the bottom side MD knuckles formed by stitching yarns of the same pair are formed under the same bottom CMD yarn.

19. The papermaking fabric defined in claim 16, wherein each of the stitching yarns forms one bottom side MD knuckle below a bottom CMD yarn.

20. The papermaking fabric defined in claim 19, wherein the bottom side MD knuckles formed of stitching yarns of the same pair are formed on adjacent bottom CMD yarns.

21. The papermaking fabrics defined in claim 16, wherein the top MD yarns of the first and second sets, the top CMD yarns, and the knuckles of the stitching yarns combine to form a plain weave papermaking surface on the fabric.

22. A method of making paper, comprising the steps of:

(a) providing a papermaking fabric, the fabric comprising:

a first set of top machine direction (MD) yarns;

a second set of top MD yarns;

a set of top cross machine direction (CMD) yarns interwoven with the first and second sets of top MD yarns;

a set of bottom CMD yarns; and a set of pairs of MD stitching yarns interwoven with the top and bottom CMD yarns, each pair of MD stitching yarns sandwiching an immediately adjacent respective top MD yarn of the second set;

wherein the first and second sets of top MD yarns interweave only with the top CMD yarns; and wherein the top MD yarns of the first set interweave in a first sequence with the top CMD yarns in which the top MD yarns of the first set form a plurality of top side MD knuckles over the top CMD yarns, and wherein the top MD yarns of the second set interweave with the top CMD yarns in a second sequence that differs from the first sequence; and wherein each of the stitching yarns forms a knuckle over a top CMD yarn over which the immediately adjacent MD yarn of the second set does not form a knuckle;

(b) depositing paper stock on the papermaking fabric; and (c) removing moisture from the papermaking stock.

* * * * *